US009200630B1

(12) United States Patent
Huff et al.

(10) Patent No.: US 9,200,630 B1
(45) Date of Patent: Dec. 1, 2015

(54) ELECTRIC OR WATER POWERED SUMP PUMP

(71) Applicant: Zeno Popa, Glenview, IL (US)

(72) Inventors: Karl Huff, Chicago, IL (US); Zeno Popa, Glenview, IL (US)

( * ) Notice: Subject to any disclaimer, the term of this patent is extended or adjusted under 35 U.S.C. 154(b) by 286 days.

(21) Appl. No.: 13/797,216

(22) Filed: Mar. 12, 2013

(51) Int. Cl.
*F04B 49/04* (2006.01)
*F04D 13/08* (2006.01)

(52) U.S. Cl.
CPC ..... *F04B 49/04* (2013.01); *F04D 13/08* (2013.01)

(58) Field of Classification Search
USPC ..... 417/36, 40, 89, 182.5, 211.5, 505
See application file for complete search history.

(56) References Cited

U.S. PATENT DOCUMENTS

| | | | | |
|---|---|---|---|---|
| 3,963,376 | A * | 6/1976 | Miskin | 417/40 |
| 4,200,122 | A * | 4/1980 | Miskin | 137/624.13 |
| 4,422,829 | A * | 12/1983 | Buchanan | 417/40 |
| 5,536,147 | A * | 7/1996 | Lang | 417/199.2 |
| 2002/0034444 | A1 * | 3/2002 | Ostrowski | 417/40 |
| 2013/0115106 | A1 * | 5/2013 | Fleischmann et al. | 417/36 |

* cited by examiner

*Primary Examiner* — Sarah McPartlin

(57) ABSTRACT

A sump pump that is powered by electricity or water pressure. During storms when electrical power is lost the pump can operate on water pressure until electrical power is restored. The sump pump is comprised of a venturi 101, electric pump 102, float operated valve 104, and level switch 105, 205, or level controller/sensor 305/314 depending on the type of level sensing used.

3 Claims, 3 Drawing Sheets

ELECTRIC OR WATER POWERED SUMP PUMP

FIELD OF INVENTION

The present invention relates to the problem of maintaining the operation of a sump pump during a power outage.

BACKGROUND

Home owner losses from flooded dwellings can be hundreds to thousands of dollars. Many homes are protected by two sump pumps, supplied by different companies, in an attempt to maintain sump pump operation during a power outage.

Typically, a sump pump powered from the grid is backed up by a battery or a water powered sump pump. The battery backup pump will run during a power outage until the batteries are exhausted (several days or more). A water powered pump will operate indefinitely as long as a source of pressurized water is available, such as city water. As city water is a reliable source of pressurized water, water powered sump pumps are becoming very popular as a reliable backup sump pump to an electrically powered sump pump.

The water powered sump pump (venturi pump) has no moving parts and can run for years without maintenance. By using a venturi pump as the primary sump pump, but powered by electricity, the same venturi pump can switch to a source of pressurized water to continue operation when power fails, and then, switch back to electricity when power is restored.

Operating such a sump pump continuously on city water would be expensive and wasteful. By producing a local source of pressurized water with an electrically powered pump, the venturi sump pump can continuously operate through power outages. Further, this sump pump will have no moving wearing parts in the sump making maintenance easier. All the equipment is wall mounted above the sump, safe and dry. A dual power sump pump that is more reliable and easier to maintain is desirable.

SUMMARY OF INVENTION

The object of this invention is to improve reliability and ease of maintenance for a sump pump that acts as its own backup.

Hence, a venturi powered by pressurized water is employed to create a vacuum sufficient to draw sump water up into the venturi and discharge the sump water with the spent pressurized water.

By adding a local source of pressurized water created by an internal electrically powered pump, the venturi can act as its own backup, using locally produced pressurized water from an internal electrically powered pump when available, and automatically switching to city water when grid power is lost.

The internal electrically powered pump is operated by a level switch that decides when the water level in the sump requires the sump to operate. On power failure, the sump water level will then trigger a solenoid valve to supply pressurized city water to the venturi to maintain sump pump operation. When power is restored, pump will automatically switch back to operation with electrical power.

The invention provides a dual power sump pump that will act as its' own backup pump that improves reliability, and ease of maintenance in a single pump package.

BRIEF DESCRIPTION OF THE DRAWINGS

Having described the invention in general terms, reference will now be made to the accompanying drawings, which are not necessarily drawn to scale, and where in.

DETAILED DESCRIPTION OF THE INVENTION

The present invention will now be described more fully hereinafter with reference to the accompanying drawings, in which some embodiments of the invention are shown. Indeed, this invention may be embodied in many different forms and should not be construed as limited to the embodiments set forth herein; rather these embodiments are provided by way of example so this disclosure will satisfy applicable legal requirements. Like numbers refer to like elements throughout.

Figure 1:
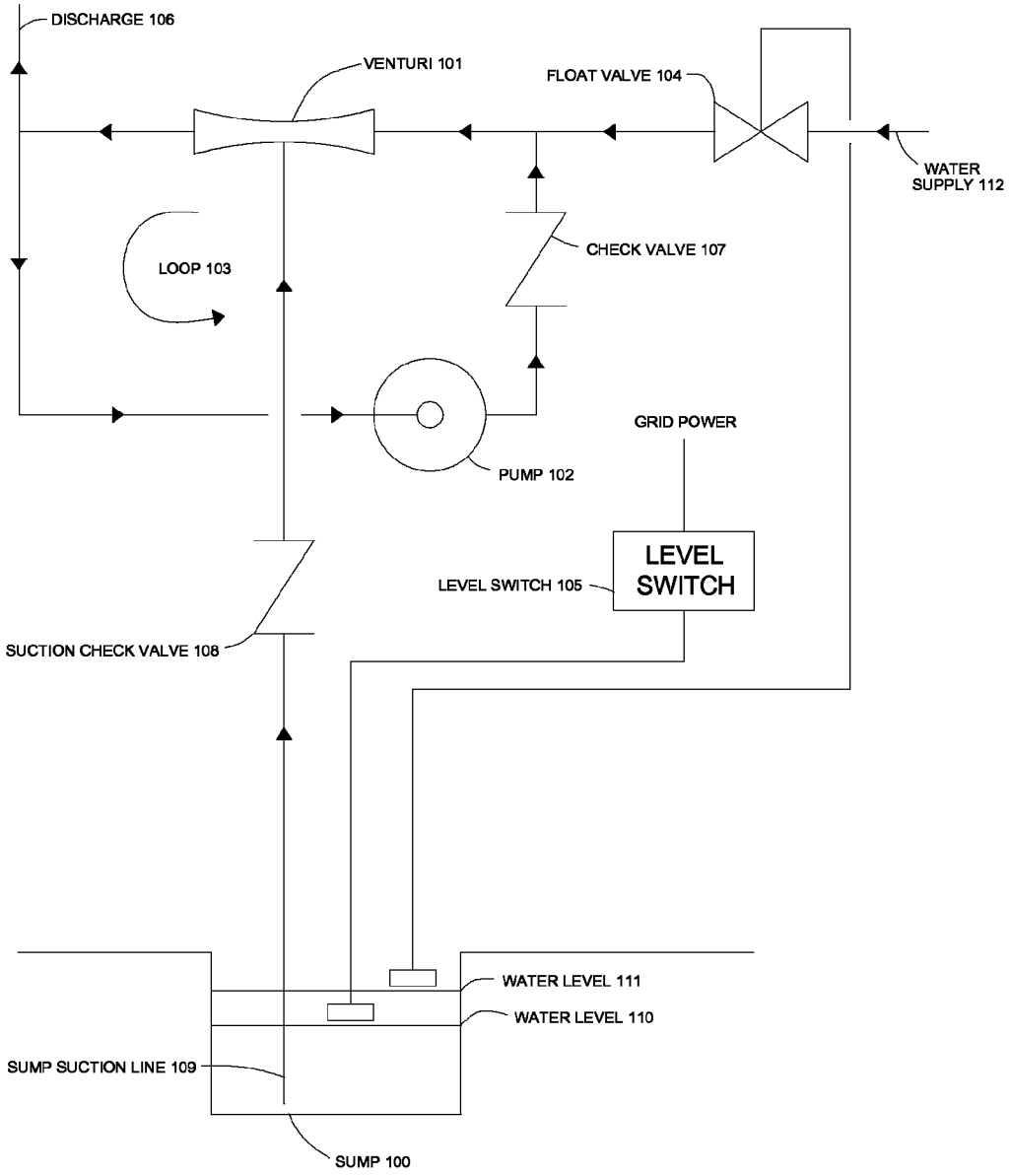
FIG. 1 shows a block diagram of a dual powered sump pump using a mechanical level sensor to operate the electrically powered pump and a float valve to send city water to the venturi.

FIG. 1 illustrates a dual powered sump pump using separate level sensors. The venturi 101 requires a source of pressurized water to operate. The primary source of pressurized water is an internal electrical pump 102 installed in loop 103. Pump 102 is controlled by level switch 105. The venturi pump 101 also has a secondary source of pressurized water, typically from a city water supply. City water flow to the venturi pump is regulated by the float valve 104. The level switch 105 operates at sump water level 110 which are below the operating water level 111 for the float valve 104.

When operating on electrical power the pump 102 takes a small amount of water from discharge 106 and pressurizes and feeds this water through the check valve 107 to the venturi 101. With float valve 104 normally closed, all the pressurized water from pump 102 passes through the venturi pump 101. This small pressurized flow creates a vacuum that will draw sump water up through the sump suction line 109 and into venturi 101. The combined water flows are sent to the discharge 106.

When power fails, the sump 100 water level will rise above water level 110 to water level 111 and open float valve 104. City water under pressure will be directed to the venturi pump 101 to maintain operation. Check valve 107 blocks city water from passing bypassing through the electrical pump 101, and thereby avoiding the venturi 101.

Check valve 108 in the sump suction line 109 maintains a prime in the venturi 101 and loop 103.

Figure 2:
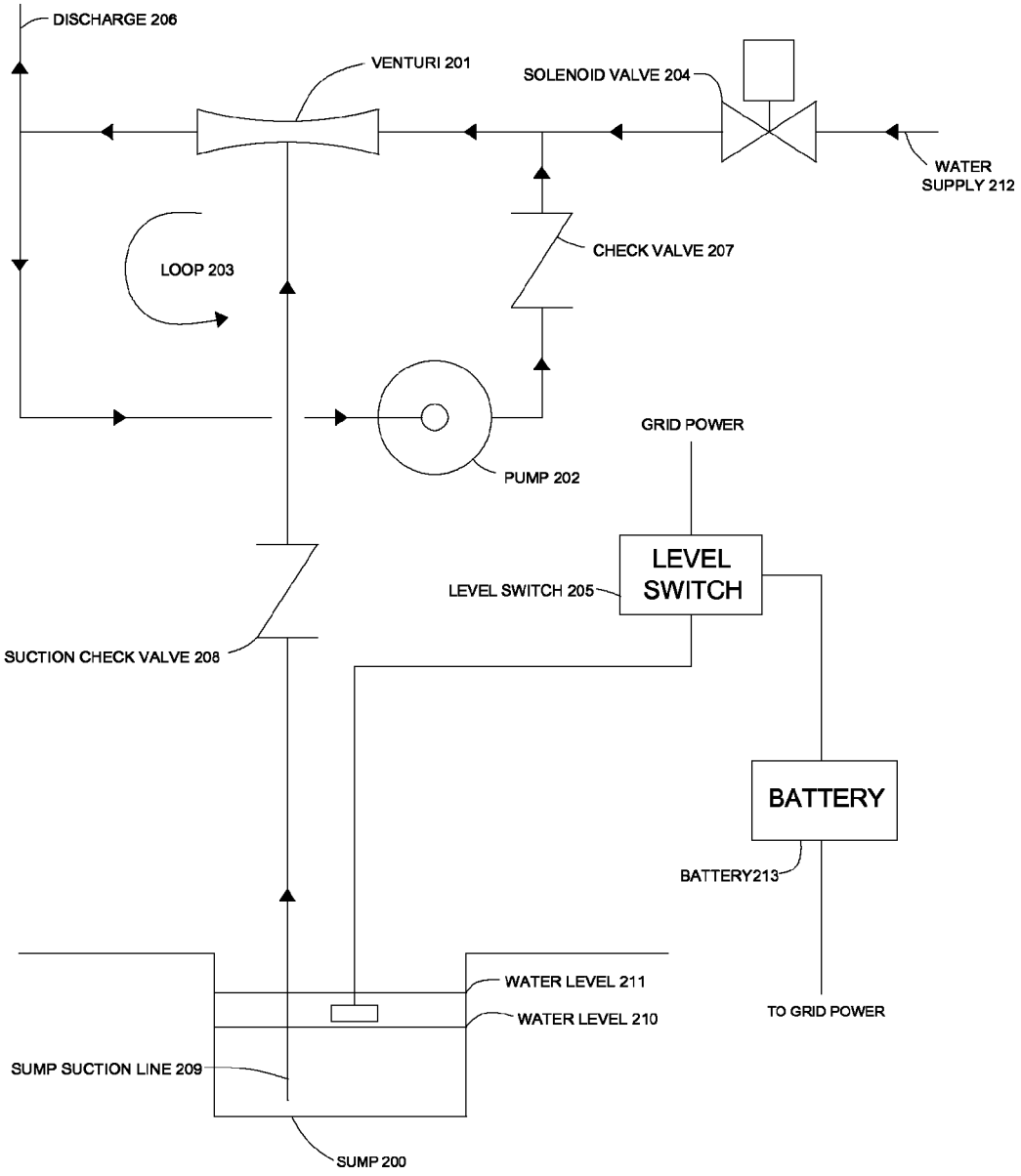
FIG. 2 shows a block diagram of a dual powered sump pump using a mechanical level sensor to operate the electrically powered pump and a control valve to send city water to the venturi.

FIG. 2 illustrated a dual powered sump pump identical to the sump pump in FIG. 1, but using a single mechanical level switch 205 to control the operation of the pump 202 and a solenoid valve 204. The level switch 205 has upper and lower switch points. The lower switch point operates pump 202, while the upper switch point operates the solenoid valve 204. A battery 213 powers the level switch 205 and the solenoid valve 204. Battery 213 is charged from the grid.

Figure 3:
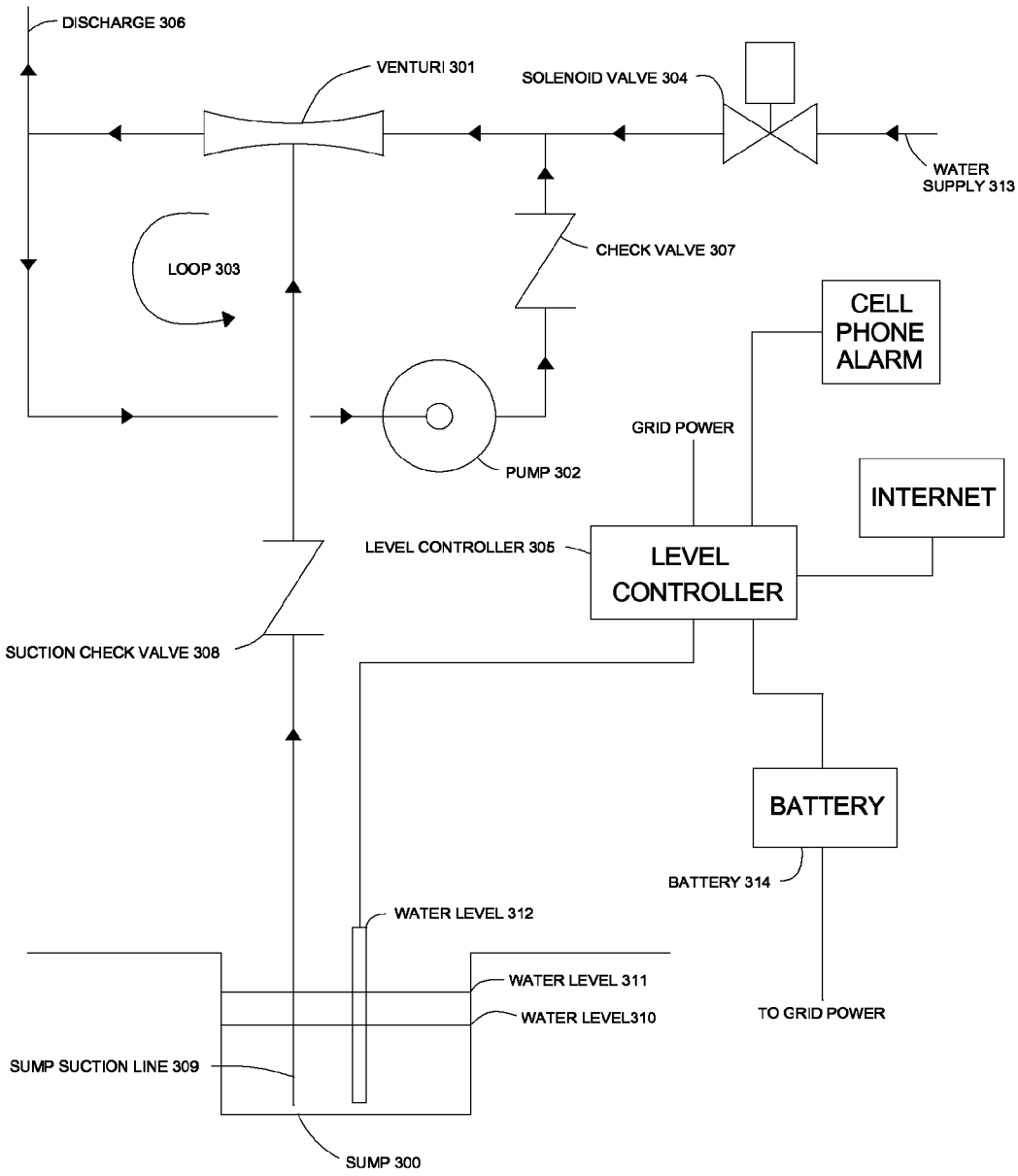
FIG. 3 shows a block diagram of a dual powered sump pump using an electronic level sensor to operate the electrically powered pump and a control valve to send city water to the venturi.

FIG. 3 illustrated a dual powered sump pump identical to the sump pump in FIG. 1, but using a single electronic level sensor/controller 305 to control the operation of the pump 302 and a solenoid valve 304. The level sensor 305 has upper and lower set points. The lower set point operates pump 302, while the upper set point operates the solenoid valve 304, Level sensor 305 can also monitor and log sump water flowrates and send system information or operational problems to the home owner by wireless or wireless/internet links. For instance, the home owner can be notified by a text message if the power is out and the sump pump is running on water power.

The invention claimed is:

1. A dual powered sump pump comprising:

an internal electric pump;

a venturi; and an actuator, wherein the actuator triggers the internal electric pump to pressurize and feed water which has accumulated in a sump to the venturi, thereby creating a vacuum to pump accumulated water from the sump, and in the absence of electricity, the actuator triggers the flow of water from an external city supplied water source to the venturi, thereby creating a vacuum to pump accumulated water from the sump during a power outage.

2. The dual powered sump pump of claim 1 wherein the actuator is a float switch which triggers the internal electric pump and alternatively triggers a solenoid valve which controls the flow of the external city supplied water during the power outage.

3. The dual powered sump pump of claim 1 wherein the actuator is a single electronic level sensor which triggers the internal electric pump and alternatively triggers a solenoid valve which controls the flow of the external city supplied water during the power outage.

* * * * *